US009815675B1

(12) United States Patent
Gray et al.

(10) Patent No.: US 9,815,675 B1
(45) Date of Patent: Nov. 14, 2017

(54) MANHOLE COVER LIFTING DEVICE

(71) Applicants: Ronald E. Gray, Sequim, WA (US); Roger Gilchrist, Sequim, WA (US)

(72) Inventors: Ronald E. Gray, Sequim, WA (US); Roger Gilchrist, Sequim, WA (US)

( * ) Notice: Subject to any disclaimer, the term of this patent is extended or adjusted under 35 U.S.C. 154(b) by 0 days.

(21) Appl. No.: 15/210,796

(22) Filed: Jul. 14, 2016

Related U.S. Application Data

(60) Provisional application No. 62/193,384, filed on Jul. 16, 2015.

(51) Int. Cl.
*B66F 3/22* (2006.01)
*B66F 19/00* (2006.01)

(52) U.S. Cl.
CPC ..... *B66F 19/005* (2013.01)

(58) Field of Classification Search
CPC ..... B66F 19/005; B66F 19/00; B66F 2700/00
See application file for complete search history.

(56) References Cited

U.S. PATENT DOCUMENTS 5,022,632 A * 6/1991 Beideck ..... B25B 27/02 254/132
5,100,104 A * 3/1992 Wagner ..... E04H 17/265 254/123
5,292,107 A * 3/1994 Chick ..... B66F 19/005 254/131
6,676,110 B1 * 1/2004 Carmouche ..... B28B 13/06 254/30
7,431,266 B1 * 10/2008 Evans ..... E04H 17/265 254/30
8,465,004 B1 * 6/2013 Fly ..... B25B 27/02 111/95
2009/0121203 A1 * 5/2009 Martini ..... B66F 15/00 254/131

* cited by examiner

*Primary Examiner* — Lee D Wilson
(74) *Attorney, Agent, or Firm* — Quickpatents, LLC; Kevin Prince

(57) ABSTRACT

A tool for removing a manhole cover that have an aperture therethrough from a manhole cover receiver comprises an elongated base, a handle, a grip, a hook member, a post, and an anvil. The aperture is an insertion point for the hook member. The handle and grip allow the user to maneuver and manipulate the tool. The hook member and post allow for lifting the manhole cover, while the anvil provides a strike face to loosen the manhole cover from the manhole cover receiver through impact of an object.

7 Claims, 3 Drawing Sheets

MANHOLE COVER LIFTING DEVICE

CROSS-REFERENCE TO RELATED APPLICATIONS

This application claims the benefit of U.S. Provisional Patent Application 62/193,384, filed on Jul. 16, 2015, and incorporated herein by reference.

STATEMENT REGARDING FEDERALLY SPONSORED RESEARCH AND DEVELOPMENT

Not Applicable.

FIELD OF THE INVENTION

This invention relates to tools, and more particularly to a lifting tool for a manhole cover.

DISCUSSION OF RELATED ART

A manhole cover can generally be described as a removable cover or lid to a manhole. A manhole cover secures the entrance to the manhole and prevents the unwanted entry of unauthorized personnel and material to a sewer system. Manhole covers are critically important to water and sewage systems because they provide necessary access and also protect the public from the harms below.

Public safety concerns require manhole covers to be secure. To achieve the required level of security, manhole covers are generally extremely heavy and made from heavy metals such as iron or steel. Furthermore, manhole covers usually contain one small hole, or "pick hole," adapted for removing the manhole cover with manhole cover remover.

Routine maintenance is very important to the quality and integrity of sewer systems. To accommodate this, manhole cover removers are needed for workers to gain access to the sewer system. Because of the various maintenance requirements of sewer systems, manhole cover removers must remove manhole covers easily and efficiently, while also being operable by a wide variety of users who have different jobs within sewer systems.

Current manhole cover removers provide a means for removing manhole covers. While these manhole cover removers enable the user to remove the manhole cover, they are rudimentary handheld devices and require great physical strength to remove the cover by use of a hook placed inside the pick hole. This prevents manhole cover removers from being used by a wide range of users, limiting their potential for efficiency and convenience. A second type of manhole cover remover employs the use of large magnets to attach to the top of the cover and then remove the cover. While these manhole cover removers provide a means of removing the covers without using the pick hole, their high cost limits their widespread use.

Therefore, there is a need for a device that quickly and easily removes manhole covers without intense physical strength or inconvenience. Furthermore, such a device should be operable by a wide variety of users while also maintaining affordability. The present invention accomplishes these objectives.

SUMMARY OF THE INVENTION

The present invention is a tool adapted to quickly and easily remove manhole covers without the need of extreme physical strength. Furthermore, the present invention is operable and affordable for the majority of potential users. This is accomplished by incorporating an aperture, an elongated base, a handle, a grip, a hook member, a post, and an anvil.

The aperture is adapted to provide an insertion point for the present invention. The handle and grip provide a means for the user to maneuver and manipulate the present invention. The hook member and post provide an attachment means for lifting the manhole cover, while the anvil provides a strike face to absorb the impact of the receiving object.

The present invention allows a wide range of users to quickly remove manhole covers. Furthermore, the present invention is easy to use and is cost-effective. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 5:
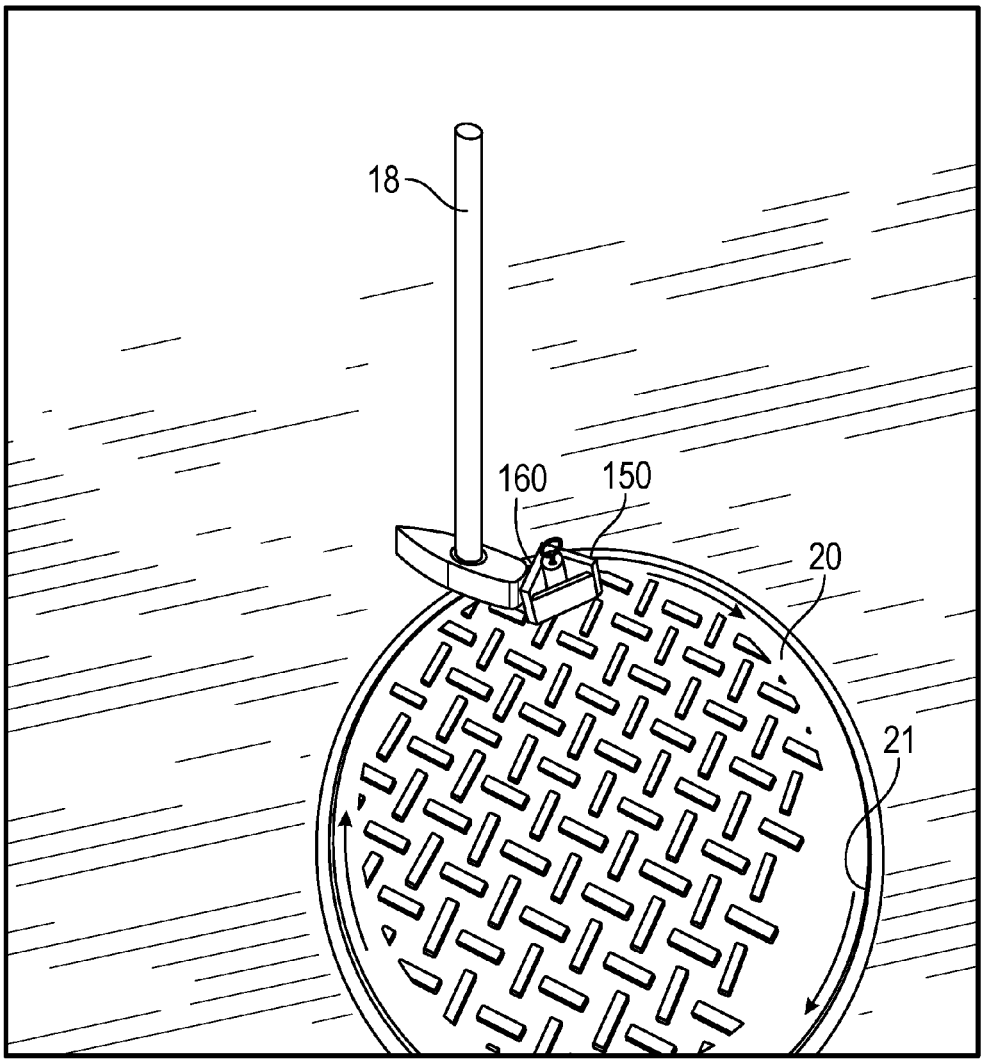
FIG. 5 is a perspective view of an anvil of the invention.

FIGS. 1-4 illustrate a tool 10 for manipulating a manhole cover 20 having an aperture 25. The invention 10 comprises an elongated base 30, a handle 50, a grip 60, a hook member 70, a post 80, and optionally an anvil 150. The handle 50 and grip 60 provide a means for the user to maneuver and manipulate the present invention 10 by hand. The hook member 70 and post 80 provide an attachment means for lifting the manhole cover 20 at its aperture 25, while the anvil 150 provides a strike face 160 to absorb the impact of an object 18, such as a sledge hammer (FIG. 5).

The elongated base 30 further comprises a pair of wheels 40 on opposing ends 38. The wheels 40 are adapted to transport the present invention 10 while also allowing the present invention 10 to transport a heavy manhole cover 20 easily and efficiently. In the preferred embodiment, the wheels 40 may be composed of metal, plastics, polyurethane, or other suitable materials.

The handle is 50 fixed at a center portion 35 of the base 30 and at a distal end 58. The handle 50 is adapted to provide a means for the user to manually control and operate the present invention 10 by hand. The handle 50 further comprises a grip 60 fixed at a proximal end 52 to provide traction for the user's hands. The handle grip 60 includes a cross-member 130 having elastomeric grips 140 on opposing ends 138. The cross-member 130 is fixed at a center portion 135 thereof with a proximal end 52 of the handle 50.

Figure 1:
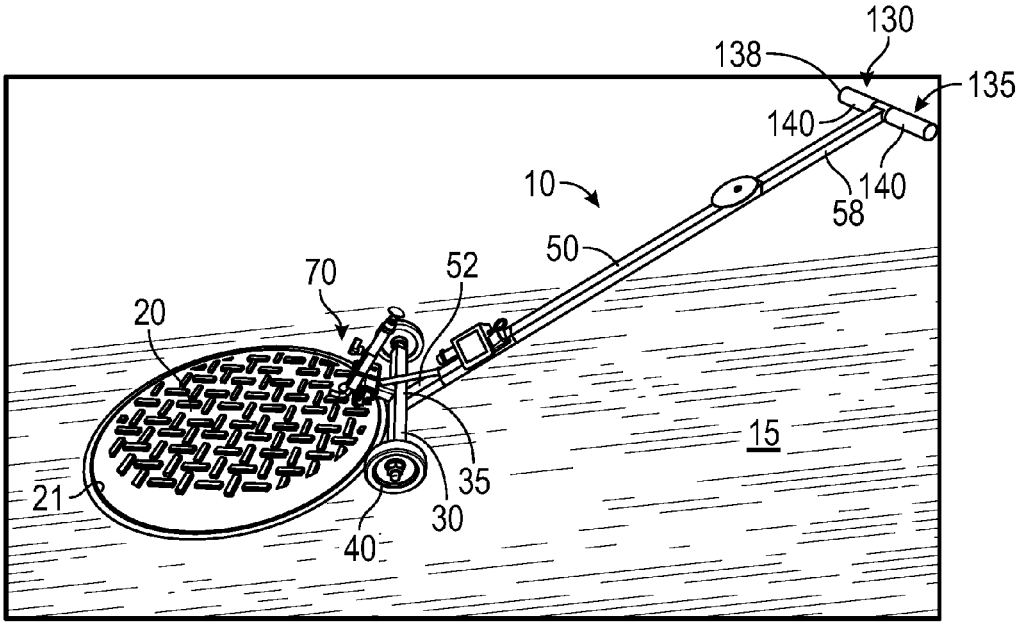
FIG. 1 is a perspective view of the invention.
Figure 2:
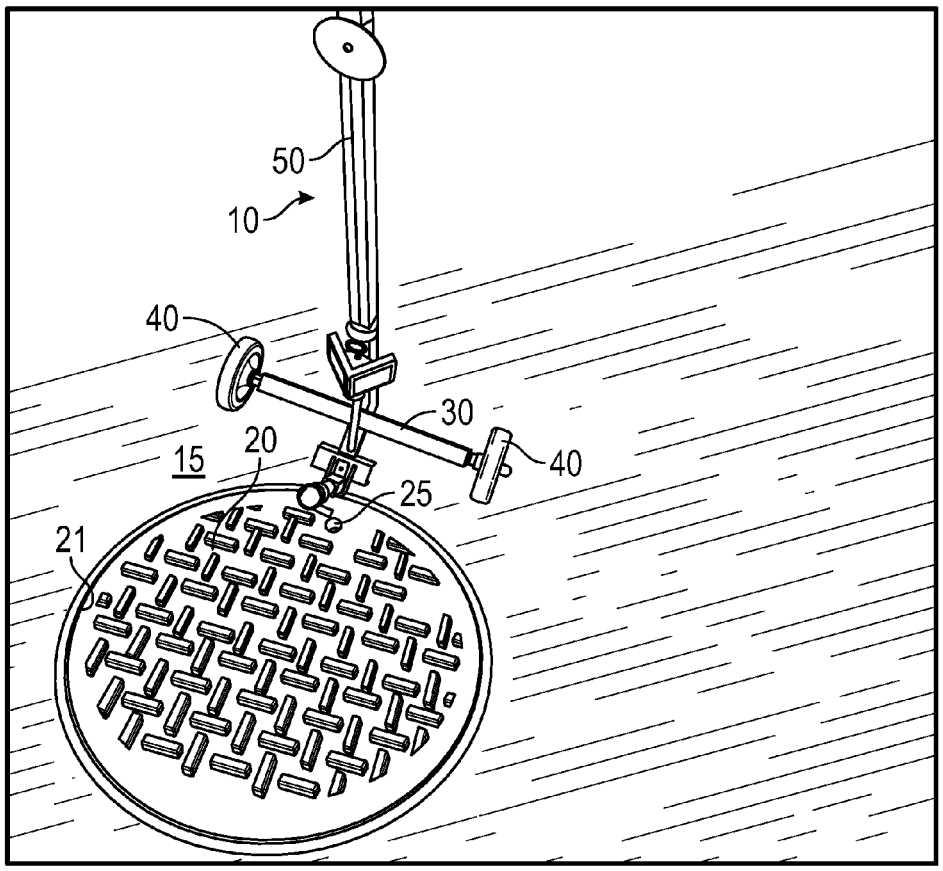
FIG. 2 is an alternate perspective view of the invention.
Figure 3:
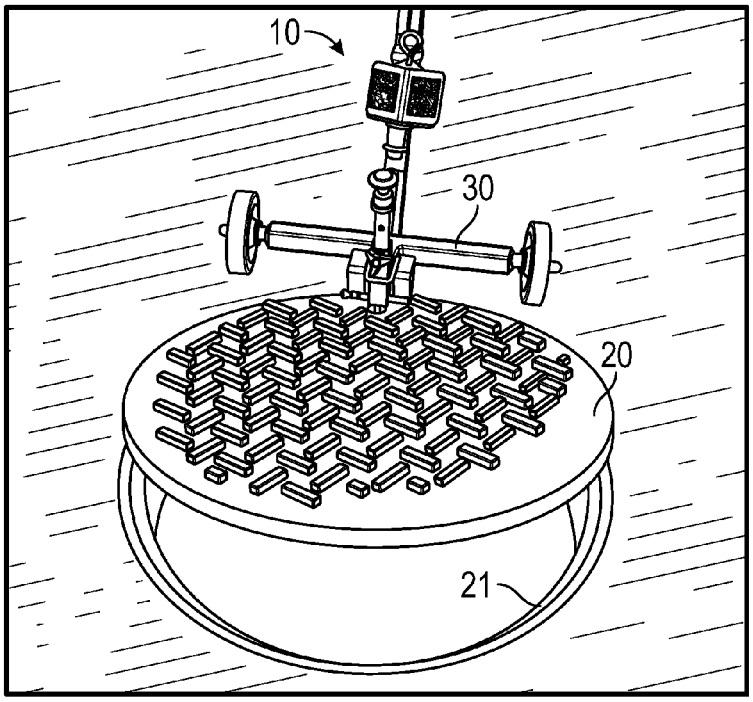
FIG. 3 is a perspective view of the invention, illustrated in-use while lifting a manhole cover.
Figure 4:
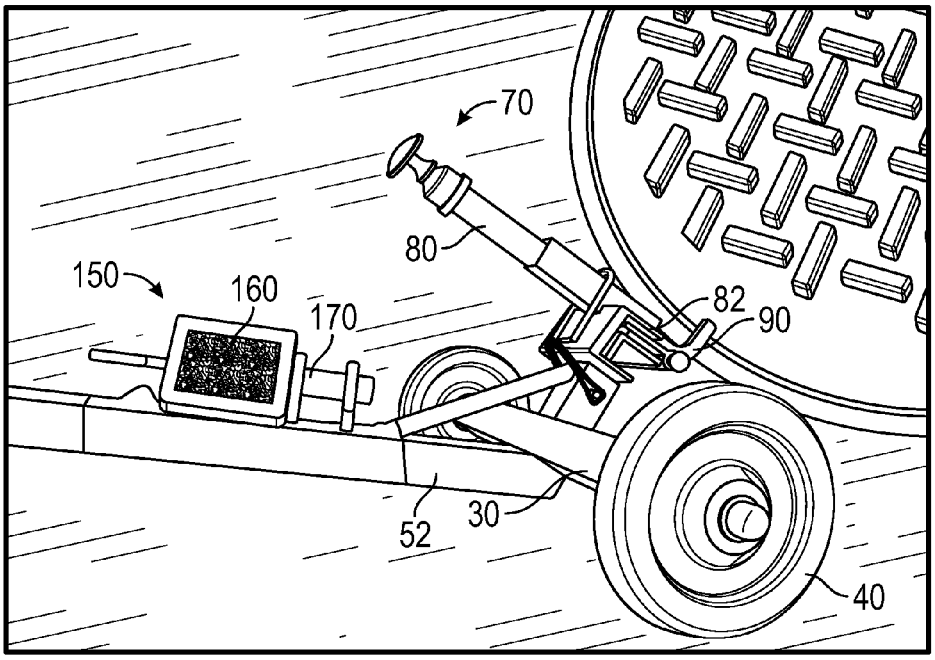
FIG. 4 is a side perspective view of the invention.

The hook member 70 is fixed with the center portion 35 of the base 30 and has an elongated upright post 80 terminating at a bottom end 82 with a perpendicular hook 90 (FIGS. 1-3). The post 80 is selectively and slidably attached with the hook member 70. In the preferred embodiment, the hook 70 member and post 80 are both adapted for insertion into the aperture 25 of the manhole cover 20 when the post 80 is not oriented vertically 100.

In an alternative embodiment, the hook member 70 is pivotally fixed with the base 30 and selectively positionable between an upright, locked position 110 and a lowered, unlocked position 120. In this alternative embodiment, the hook 70 and post 80 are inclined for insertion into the aperture 25 of the manhole cover 20 when the hook member 70 is in the lowered, unlocked position 120.

The anvil 150 is adapted for partial insertion into the manhole cover aperture 25. The anvil 150 has at least one strike face 160 for receiving the blow of an object 18 and an attachment mechanism 170 for selectively fixing with the present invention 10 allowing for storage. When the anvil 150 is partially inserted into the aperture 25 of the manhole cover 20, the strike face 160 is struck by the object 18 at an angle tangential to the manhole cover 20 to disengage the manhole cover 20 from a manhole cover receiver 21 in the ground surface 15.

When in use, the user must first position the present invention 10 at an incline such that the post 80 is not oriented vertically 100. Next, the user will insert the hook 70 and post 80 through the aperture 25 of the manhole cover 20. Then, the user will pull the handle 50 rearward such that the post 80 is generally oriented vertically. Next, the user will pull the handle 50 further rearward such that the hook 70 and post 80 together lift the manhole cover 20 upward such that the manhole cover is supported by the present invention 10. Next, the user will manipulate the handle 50 to move the manhole cover 20 about a ground surface 15 supported by the wheels 40.

While a particular form of the invention has been illustrated and described, it will be apparent that various modifications can be made without departing from the spirit and scope of the invention. For example, materials, shapes, and sizes have been designated, although any suitable material, shape, and size may be used. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A tool for manipulating a manhole cover of the type having an aperture therethrough, the tool comprising:

an elongated base having a pair of wheels on opposing ends thereof;

a handle fixed at a center portion of the base at a distal end thereof, the handle having a grip fixed at a proximal end thereof;

a hook member fixed with the center portion of the base and having an elongated upright post terminating at a bottom end with a perpendicular hook, the hook and post adapted for insertion into the aperture of the manhole cover when the post is not vertically oriented;

an anvil adapted for partial insertion into the manhole cover aperture, the anvil having at least one strike face for receiving the blow of an object and an attachment mechanism for selectively fixing with the tool for storage thereof;

whereby with the tool inclined so that the post is not vertically oriented the hook and post are inserted through the aperture of the manhole cover, the handle then pulled rearward to orient the post generally vertically, the handle then pulled further rearward so that the hook and post together lift the manhole cover upward to be supported by the tool, the handle then manipulated to move the manhole cover about a ground surface supported by the wheels, and whereby with the anvil partially inserted into the aperture of the manhole cover, the strike face is struck by the object at an angle tangential to the manhole cover to disengage the manhole cover from a manhole cover receiver in the ground surface.

2. The tool of claim 1 wherein the hook member is pivotally fixed with the base and selectively positionable between an upright, locked position and a lowered, unlocked position, whereby the hook and post are inclined for insertion into the aperture of the manhole cover when the hook member is in the lowered, unlocked position.

3. The tool of claim 1 wherein the handle grip includes a cross-member having elastomeric grips on opposing ends thereof, the cross-member fixed at a center portion thereof with the proximal end of the handle.

4. The tool of claim 1 wherein the post is selectively and slidably attached with the hook member.

5. The tool of claim 2 wherein the handle grip includes a cross-member having elastomeric grips on opposing ends thereof, the cross-member fixed at a center portion thereof with the proximal end of the handle.

6. The tool of claim 2 wherein the post is selectively and slidably attached with the hook member.

7. The tool of claim 3 wherein the post is selectively and slidably attached with the hook member.

* * * * *